US005881875A

United States Patent [19]

Beurekjian

[11] Patent Number: 5,881,875

[45] Date of Patent: Mar. 16, 1999

[54] COMBINATION CARRYING CASE AND STAND FOR TENNIS EQUIPMENT

[76] Inventor: Marty Beurekjian, 5577 W. Glenoaks Blvd., Glendale, Calif. 91202

[21] Appl. No.: 762,333

[22] Filed: Dec. 9, 1996

[51] Int. Cl.[6] ..... A63B 49/00

[52] U.S. Cl. ..... 206/315.9; 206/315.1; 211/14; 211/85

[58] Field of Search ..... 206/315.1, 315.9, 206/315.2, 315.5, 216, 223, 495; 211/60.1, 72, 88, 198, 199, 200, 13.1, 14; 224/917; 294/143, 146

[56] References Cited

U.S. PATENT DOCUMENTS

| | | | |
|---|---|---|---|
| D. 231,150 | 4/1974 | Berry | 206/315.1 |
| 2,186,491 | 1/1940 | Meyer | 206/315.7 |
| 4,036,416 | 7/1977 | Lowe | 294/143 |
| 4,643,317 | 2/1987 | Wilkinson et al. | 211/14 |
| 4,666,038 | 5/1987 | Minneman | 294/143 |
| 4,913,439 | 4/1990 | Ellington | 206/315.1 |
| 5,082,218 | 1/1992 | Hoffman | 206/315.5 |
| 5,209,539 | 5/1993 | Atalay | 211/198 |

*Primary Examiner*—David T. Fidei
*Assistant Examiner*—Luan K. Bui
*Attorney, Agent, or Firm*—Erik M. Arnhem

[57] ABSTRACT

A carrying case for tennis equipment, in the form of a flat panel mounted to the front legs of a foldable tripod. Pockets for tennis racquets, tennis balls and tennis shoes are affixed to the front surface of the panel for easy viewing and easy access. The tripod construction can be folded into a flat panel configuration for carrying in suitcase fashion.

6 Claims, 1 Drawing Sheet

COMBINATION CARRYING CASE AND STAND FOR TENNIS EQUIPMENT

BACKGROUND AND SUMMARY OF THE INVENTION

This invention relates to a combination carrying case and stand for tennis equipment, e.g. tennis racquets, tennis balls and tennis shoes.

Various carriers have been devised for carrying tennis racquets and related equipment. U.S. Pat. No. 3,963,103, to A. T. Cowen, discloses a carrying case comprising a main clothing compartment having a zippered access opening, and an auxiliary racquet compartment having a pair of zippered access openings partially closing the compartment with the racquet handle protruding upwardly beyond the case top wall.

U.S. Pat. No. 4,023,800 to P. Haggerty, shows a carrying case for a tennis racquet and tennis balls, formed by two rigid hollow case sections hingedly connected together, similar to a conventional violin case construction.

U.S. Pat. No. 4,177,845 to F. Intengan, relates to a case for a tennis racquet and tennis balls, formed of two hollow mirror image case sections. Each case section has a contoured interior surface forming a cavity conforming to the shape of the tennis racquet being stored in the case.

U.S. Pat. No. 4,179,054, to E. Bredehoeft, et al shows a tennis racquet carrier having two slot-like chambers for a pair of tennis racquets and a hinged side panel for closing a tennis ball compartment located beneath the handles of the stored tennis racquets.

U.S. Pat. No. 4,378,866, to J. Pelavin, discloses a flexible bag for containing items of clothing. An external panel is connected to one wall of the bag to form an external pocket adapted to receive a tennis racquet.

The present invention relates to a combination carrying case and stand for tennis equipment, e.g. three tennis racquets, several tennis balls, and a pair of tennis shoes. In preferred practice of the invention a foldable tripod structure is provided for supporting a fabric panel that mounts a number of individual pockets sized to receive tennis racquets, tennis balls and tennis shoes. For transportation purposes the tripod structure is folded into a narrow flat configuration suitable for carrying in suitcase fashion. At the tennis court the tripod structure is unfolded to form an upright stand; the pockets on the fabric panel are accessed to remove the tennis items for normal usage.

The upright stand is advantageous in that each pocket is fully visible and accessible, such that the person is unlikely to forget to place the tennis equipment in the pockets at home or at the tennis court. By having the individual pockets on an upright panel the pockets are separated and visible, whereby the person can visually check the condition of each pocket (full or empty).

Further features and advantages of the invention will be apparent from the attached drawings and description of an illustrative embodiment of the invention.

IN THE DRAWINGS

DESCRIPTION OF A PREFERRED EMBODIMENT OF THE INVENTION

The drawings show a combination case and stand for housing tennis equipment, specifically three tennis racquets, several tennis balls, and a pair of tennis shoes. The construction includes a foldable tripod structure that comprises two front legs 10 and a single rear leg 12.

Figure 1:
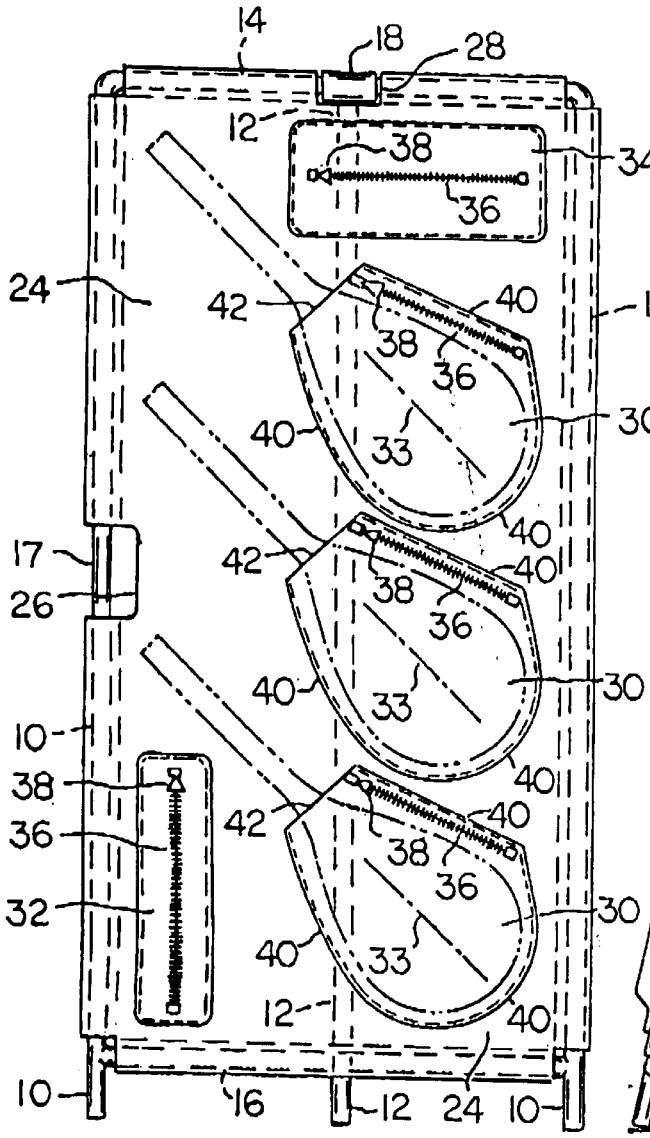
FIG. 1 is a plan view of a combination carrying case and stand embodying the invention.

Front legs 10 are connected together by an upper crosspiece 14 and a lower crosspiece 16. Rear leg 12 has a transverse tubular connector 18 freely encircling crosspiece 14, whereby the rear leg can be swung around crosspiece 12. toward the front legs or away from the front legs. FIG. 1 shows the tripod structure in a folded condition suitable for transportation in suitcase fashion. Exposed area 17 of the left front leg 10 serves as a carrying handle.

The tripod structure components can be rod or tube stock of various materials, e.g. aluminum, steel or plastic. As shown in the drawing, the two front legs 10, 10 are integral with the upper crosspiece 14. However, the crosspiece can be a separate component that is joined to legs 10, 10 as an assembly operation.

Figure 3:
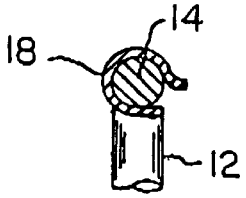
FIG. 3 is a sectional view taken through a structural detail that can be used in the FIG. 1 device.

Tubular connector 18 can be a spring clip, as shown in FIG. 3. The resilience of the clip material allows the clip to be snapped over crosspiece 14 to a condition where the clip can swivel on the crosspiece. Excessive swinging motion of rear leg 12 around crosspiece 14 can be prevented by a chain or cable 20 trained between crosspiece 16 and rear leg 12.

When the tripod structure is in the carrying mode (FIG. 1) the rear leg 12 is swung toward the front legs so as to abut crosspiece 16. A spring clip 22 affixed to the crosspiece releasably retains the rear leg in a folded condition, whereby the tripod structure can be carried by the person, i.e. by grasping handle 17.

The tripod structure is designed so that front legs 10, 10, are parallel with each other. The legs and crosspieces thus form a rectangular frame. A panel 24 is supported on the defined frame. This panel can be a rigid sheet of material, e.g. sheet plastic. However, the panel is preferably a flexible fabric material, e.g. a flexible non-woven sheet of plastic or simulated leather or a flexible woven fabric sheet.

Edge areas of the sheet (panel) are extended around the frame components 10, 10, 14 and 16, and secured to the rear surfaces of the panel material as by stitching or electronic welding. Cutouts 26 and 28 are provided in the panel edge to form the handle 17 and clearance for connector 18.

Panel 24 provides a mounting surface for fabric patches that provide storage pockets for various tennis equipment, e.g. three tennis racquets, several tennis balls, and a pair of tennis shoes. FIG. 1 shows, in dashed lines, a tennis racquet in a stored position in one of the pockets designated by numeral 30. Tennis balls are stored in an elongated pocket structure 32. A pair of tennis shoes can be stored in pocket structure 34.

Each of the pocket structures 30, 32 or 34 has a zipper 36 for closing the pocket access opening. In the drawing the slide fastener for each zipper is denoted by numeral 38. Each slide fastener 38 can be moved back and forth along the zipper length to open or close the associated pocket access opening. The zippers are advantageous in that they prevent the stored items from falling out of the pockets when the structure is in the carrying mode.

Pocket structures 32 and 34 are preferably three dimensional in nature, being constructed similarly to fabric pockets commonly used on golf bags. The patch of material for each pocket structure 32 or 34 can be cut and sewn into into a three dimensional shape and then attached at its peripheral edge to panel 24, to form the three dimensional pocket.

The patch of material for each pocket 30 can be a single planar wall attached to panel 24 around approximately eighty percent of its peripheral edge, as denoted by numeral 40 in the drawings. Edge area 42 of the patch is detached from panel 24, to provide clearance for the handle of the stored tennis racquet. The patch of material secured to panel 24, as at 40, forms the front wall of pocket structure 30. Attached edge area 40 extends along the lower edge, right side edge, and upper edge of the pocket structure.

The front wall of each pocket 30 is slit from edge area 42 at an acute angle to form mounting surfaces for the associated zipper 36. When the zipper fastener is moved to the open position, a portion of the pocket front wall forms a flap that can be swung out, to permit insertion or removal of the tennis racquet.

In preferred practice of the invention the tennis racquet pockets 30 have their axes 33 parallel and acutely angled to front legs 10, 10, in order to most effectively use the available area on panel 24, without having the handles of tennis racquets protrude beyond the panel edges. The stored tennis racquets are visible, while at the same time safely positioned against dropping or otherwise becoming separated from panel 24.

The pocket front walls can be formed of opaque materials. Alternately, at least some of the pocket front walls can be transparent or semi-transparent to permit the person to see whether pockets 32 and 34 are full or empty.

Figure 2:
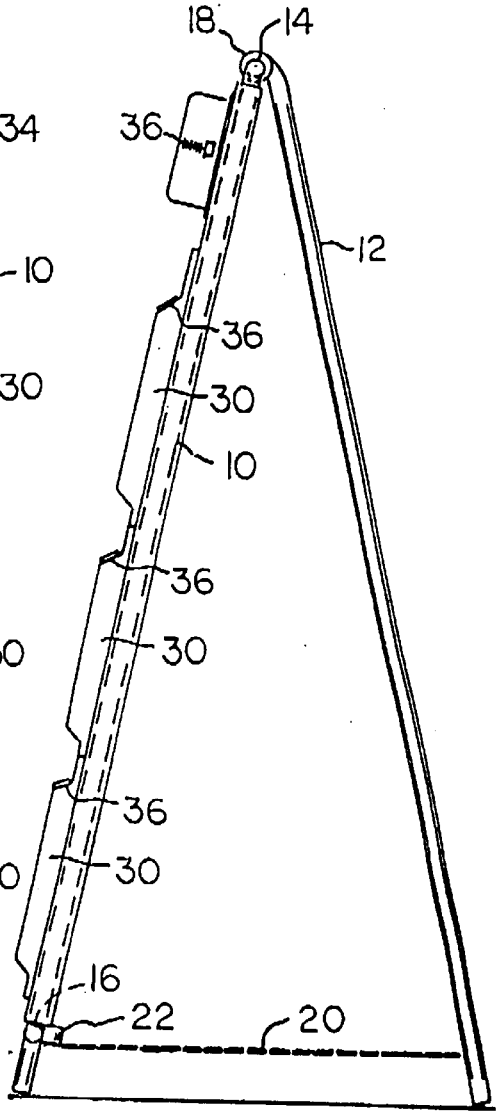
FIG. 2 is a side elevational view of the FIG. 1 structure, taken with the stand in an upright condition on a ground surface.

A principal advantage of the tennis equipment storage structure is that the pockets are clearly visible when the structure is in its upright position (FIG. 2). The person is reminded of the necessity for placing the balls, racquets and shoes in the carrier prior to departing from the tennis court.

Another advantage of the illustrated construction is that the flat panel 24 requires a relatively small quantity of material and minimal forming operations. The wall structure does not require fabrication into a three dimensional container configuration; instead the panel is a relatively simple structure that is easily manufactured.

The construction is particularly designed for use by tennis players when playing the game. However, the structure can also be used in a store setting for display purposes. The store is enabled to market the assembly (including the racquets, balls and shoes) as a complete sales package for introducing the shopper to the game of tennis.

What is claimed is:

1. A combination carrying case and stand for tennis equipment comprising:

a foldable tripod structure that includes two front legs and a single rear leg hingedly connected together so that the rear leg can swing toward or away from the front legs;

a rectangular panel spanning said front legs for movement therewith; and a plurality of separate tennis equipment pockets on said panel facing away from the rear leg, so that when the rear leg is swung away from the front legs the panel can assume an upright position wherein said pockets are individually accessible;

said pockets comprising plural tennis racquet pockets acutely angled to said front legs at a common angulation;

said tennis racquet pockets being arranged in a vertical row; each tennis racquet pocket being sized to enclose the head area of a tennis racquet, leaving the handle of the racquet exposed, whereby the racquet handle can be grasped to insert or remove the racquet from the associated pocket;

said tennis racquet pockets being oriented on the panel so that when a tennis racquet is housed in each tennis racquet pocket the handles of the racquets are located within the space directly in line with the panel.

2. The combination carrying case and stand of claim 1, wherein each tennis racquet pocket comprises a planar wall having a lower edge area and a first side edge area secured to said panel; said planar wall having an upper edge area secured to said panel and a second side edge area (42) detached from said panel, whereby a tennis racquet housed in the respective pocket will have its handle extended through the space provided by said second side edge area.

3. The combination carrying case and stand of claim 2, and further comprising a zipper means extending along the upper edge area of each tennis racquet pocket planar wall, so that when said zipper means is in an open condition a portion of said planar wall forms a movable flap that can be drawn away from said panel to permit insertion or removal of a tennis racquet.

4. A combination carrying case and stand for tennis equipment comprising:

a foldable tripod structure that includes two parallel front legs and a single rear leg hingedly connected together so that the rear leg can swing toward or away from the front legs;

a rectangular panel spanning said front legs for movement therewith.; and a plurality of separate tennis equipment pockets on said panel facing away from the rear leg, so that when the rear leg is swung away from the front legs the panel can assume an upright position wherein said pockets are individually accessible;

said pockets comprising plural tennis racquet pockets arranged in a vertical row on the panel; each tennis racquet pocket having an imaginary axis (33) acutely angled to said parallel front legs; each tennis racquet pocket comprising a front wall having a marginal edge area secured to said panel to form a pocket space for enclosing the head area of one tennis racquet; each front wall having an upwardly angled edge area detached from the panel to provide a clearance space for the handle area of a tennis racquet; each front wall having a zipper means acutely angled to said detached edge area, so that when said zipper means is in an open condition said front wall forms a movable flap that can be drawn away from said panel to permit insertion or removal of a tennis racquet.

5. The combination carrying case and stand of claim 4, wherein said pockets further include a ball storage pocket on said panel, and a shoe storage pocket on said panel; said panel having an upper edge and a lower edge; said ball storage pocket being located alongside the row of tennis racquet pockets proximate to the panel lower edge; said shoe storage pocket being located above the row of tennis racquet pockets proximate to the panel upper edge.

6. The combination carrying case and stand of claim 5, wherein said panel has a cut out (26) along an edge thereof proximate to one of said front legs, whereby a person can grasp an area of said one front leg exposed by said cut out for carrying the case from place to place.

* * * * *